US010126045B2

(12) United States Patent
Hammond et al.

(10) Patent No.: US 10,126,045 B2
(45) **Date of Patent: *Nov. 13, 2018**

(54) INTERACTIVE LIGHTING IN A REFRIGERATOR

(71) Applicant: WHIRLPOOL CORPORATION, Benton Harbor, MI (US)

(72) Inventors: Richard L. Hammond, Grand Haven, MI (US); Michael T. Moore, Paw Paw, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 143 days.

This patent is subject to a terminal disclaimer.

(21) Appl. No.: 15/236,859

(22) Filed: Aug. 15, 2016

(65) Prior Publication Data

US 2016/0348960 A1 Dec. 1, 2016

Related U.S. Application Data

(63) Continuation of application No. 14/225,481, filed on Mar. 26, 2014, now Pat. No. 9,435,581.

(51) Int. Cl.
*F25D 27/00* (2006.01)
*F25D 25/02* (2006.01)
(Continued)

(52) U.S. Cl.
CPC ..... *F25D 27/005* (2013.01); *F21K 9/20* (2016.08); *F21K 9/68* (2016.08); *F21V 5/04* (2013.01); *F21V 7/00* (2013.01); *F21V 17/02* (2013.01); *F21V 23/04* (2013.01); *F21V 33/0044* (2013.01); *F25D 11/02* (2013.01); *F25D 25/025* (2013.01); *F25D 27/00* (2013.01); *F25D 29/005* (2013.01); *F21V 14/04* (2013.01);
(Continued)

(58) Field of Classification Search
CPC ..... F25D 27/005; F25D 11/02; F25D 27/00; F21V 7/00; F21V 14/04
See application file for complete search history.

(56) References Cited

U.S. PATENT DOCUMENTS 5,873,646 A 2/1999 Fjaestad et al.
7,147,341 B2 12/2006 Nowak et al.
(Continued)

FOREIGN PATENT DOCUMENTS

CN 1987302 A 6/2007
DE 10107654 A1 8/2002
(Continued)

OTHER PUBLICATIONS

European Patent Office, "European Search Report," issued in connection with European Patent Application No. 15159974.3-1605 dated Aug. 7, 2015, 8 pages.

*Primary Examiner* — Karabi Guharay
(74) *Attorney, Agent, or Firm* — Nyemaster Goode, P.C.

(57) ABSTRACT

A refrigerator includes a refrigerator cabinet, a light system associated within an interior of the refrigerator cabinet, the light system including a light source, a reflector having a first position wherein light from the light source is directed in a first direction and a second position wherein the light from the light source is directed in a second direction, and wherein the refrigerator is configured to move the reflector between the first position and the second position based on interactions between a user of the refrigerator and the refrigerator.

18 Claims, 5 Drawing Sheets

(51) Int. Cl.

| | |
|---|---|
| ***F21V 7/00*** | (2006.01) |
| ***F21V 17/02*** | (2006.01) |
| ***F21K 9/20*** | (2016.01) |
| ***F21V 5/04*** | (2006.01) |
| ***F21V 23/04*** | (2006.01) |
| ***F21V 33/00*** | (2006.01) |
| ***F25D 11/02*** | (2006.01) |
| ***F25D 29/00*** | (2006.01) |
| ***F21K 9/68*** | (2016.01) |
| *F21W 131/305* | (2006.01) |
| *F21Y 101/00* | (2016.01) |
| *F21Y 115/10* | (2016.01) |
| *F21V 14/04* | (2006.01) |

(52) U.S. Cl.
CPC .... *F21W 2131/305* (2013.01); *F21Y 2101/00* (2013.01); *F21Y 2115/10* (2016.08)

(56) References Cited

U.S. PATENT DOCUMENTS

| | | | |
|---|---|---|---|
| 8,327,657 | B2 | 12/2012 | Min et al. |
| 2007/0115649 | A1 | 5/2007 | Gotz |
| 2010/0098974 | A1 | 4/2010 | Kim et al. |
| 2012/0230015 | A1 | 9/2012 | Zhu et al. |

FOREIGN PATENT DOCUMENTS

| | | | |
|---|---|---|---|
| JP | 2010230206 | A | 10/2010 |
| JP | 2011043263 | A | 3/2011 |
| JP | 2011052943 | A | 3/2011 |
| JP | 2012048991 | A | 3/2012 |
| JP | 2014016157 | A | 1/2014 |
| KR | 2008103639 | A | 4/2010 |
| KR | 2010041052 | A | 4/2010 |
| KR | 2010041055 | A | 4/2010 |
| WO | 2007125122 | A1 | 11/2007 |

INTERACTIVE LIGHTING IN A REFRIGERATOR

CROSS-REFERENCE TO RELATED APPLICATIONS

This application is a continuation of patent application Ser. No. 14/225,481, filed Mar. 26, 2014, now U.S. Pat. No. 9,435,581, entitled "INTERACTIVE LIGHTING IN A REFRIGERATOR", the disclosure of which is hereby incorporated herein by reference in its entirety.

FIELD OF THE INVENTION

The present invention relates to refrigerators. More particularly, the present invention relates to interactive lighting in refrigerator.

BACKGROUND OF THE INVENTION

One of the problems with refrigerator lighting is that lighting solutions do not necessarily take into account how use of the refrigerator can affect lighting. By way of example only, consider a refrigerator drawer. Conventionally when a drawer such as a crisper is lit, the light is configured to shine down and back to illuminate the product stored within the drawer. However, when the drawer is extended, the light may remain shining down and back into the space that the crisper has vacated. With the consumer standing in front of the crisper it is difficult to rely on external lighting to properly illuminate the now open drawer. Thus, problems remain with refrigerator lighting.

SUMMARY OF THE INVENTION

According to one aspect, a refrigerator is provided. The refrigerator includes a refrigerator cabinet, a light system associated within an interior of the refrigerator cabinet, the light system including a light source, a reflector having a first position wherein light from the light source is directed in a first direction and a second position wherein the light from the light source is directed in a second direction, and wherein the refrigerator is configured to move the reflector between the first position and the second position based on interactions between a user of the refrigerator and the refrigerator. The reflector may be a rotatable reflector. The light source may be positioned proximate as drawer of the refrigerator. The reflector may be in a first position when the drawer is closed and a second position when the drawer is open (partially or fully). The light source may be positioned on an interior side of the refrigerator cabinet. There may be elements on sides of the drawer configured to control rotation of a rotatable reflector between the first position and the second position with movement of the drawer between an open position and a closed position. The elements may be molded-in elements. The drawer may be a crisper drawer. The light source may include an LED.

According to another aspect, a refrigerator is provided. The refrigerator includes a refrigerator cabinet, a drawer disposed within the refrigerator cabinet, and a light system associated with the drawer. The light system may include a light source and a rotatable reflector having a first position wherein light from the light source is directed to light the drawer when the drawer is in a closed position and a second position wherein light from the light source is directed to light the drawer when the drawer is in an open position. The refrigerator may further include elements on sides of the drawer configured to control rotation of the rotatable reflector when the drawer transitions between the closed position and the open position. The elements may be molded on the sides of the drawer. The drawer may be a crisper drawer. The light source may include an LED. The light system may further include an optic lens for directing light from the light source.

According to another aspect, a method of controlling interactive lighting in a refrigerator is provided. The method includes providing a refrigerator having a refrigerator cabinet and a light system associated within an interior of the refrigerator cabinet. The light system may include a light source, a reflector having a first position wherein light from the light source is directed in a first direction and a second position wherein the light from the light source is directed in a second direction, and wherein the refrigerator is configured to move the reflector between the first position and the second position based on interactions between a user of the refrigerator and the refrigerator. The method may further include moving the reflector between the first position and the second position based on the interactions between the user of the refrigerator and the refrigerator. The interactions between the user of the refrigerator and the refrigerator may include the user moving a component of the refrigerator. The component may be a drawer and the moving the drawer involve opening or closing the door.

DETAILED DESCRIPTION

Refrigerators and related apparatus, methods, and systems for interactive lighting are provided. The manner in which lighting is provided may be altered in response to the manner in which an individual uses or otherwise interacts with the refrigerator. In one aspect, the position of reflectors within the refrigerator may be altered in response the user's interactions with the refrigerator.

Figure 1:
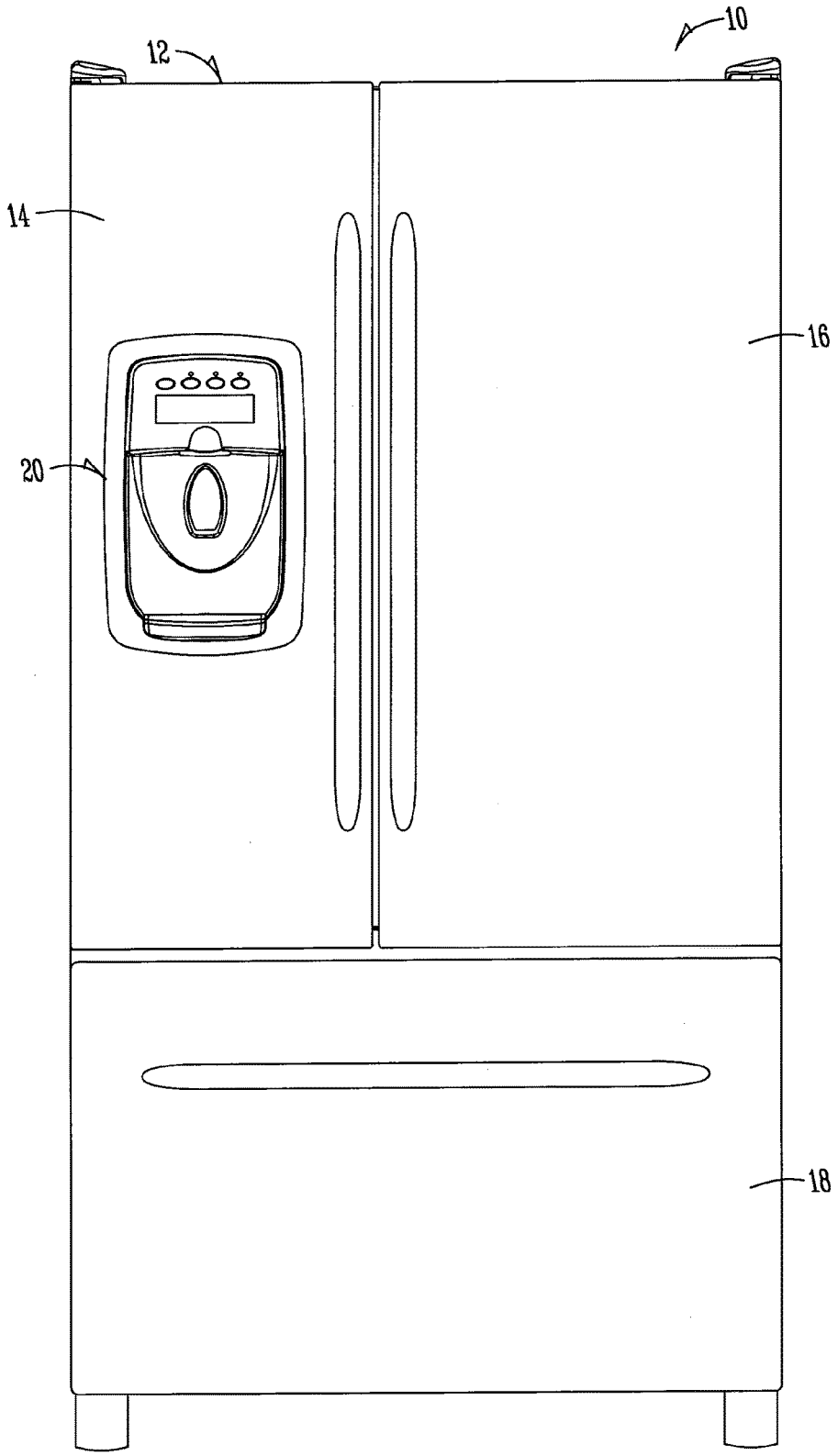
FIG. 1 illustrates a refrigerator.
Figure 2:
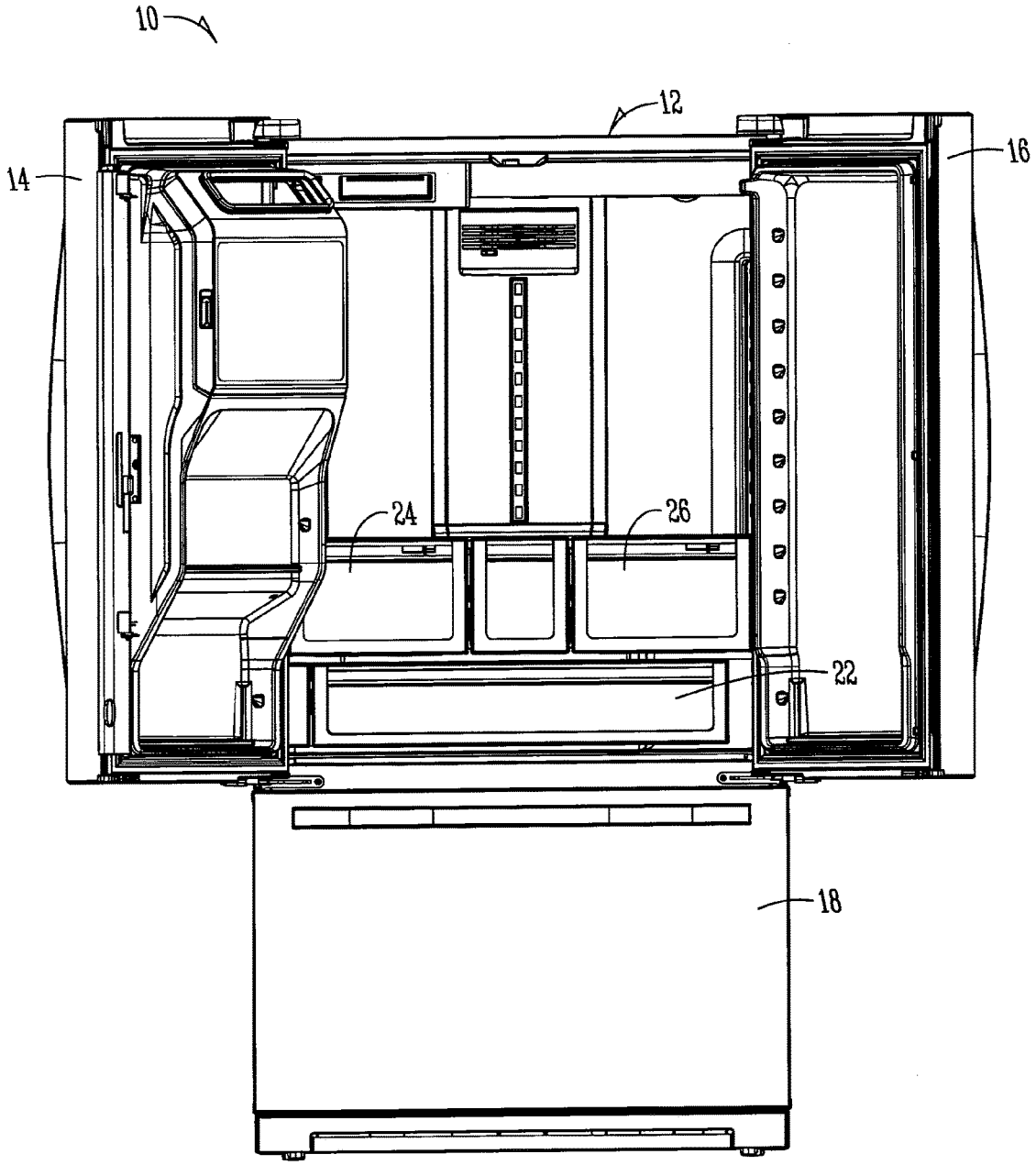
FIG. 2 illustrates the refrigerator of FIG. 1 with the fresh food compartment doors open.

FIG. 1 illustrates one example of a refrigerator. The refrigerator 10 is a refrigerator cabinet 12 with French doors 14, 16 providing access to a fresh food compartment and a drawer 18 providing access to a freezer compartment. A water/ice dispenser 20 is also shown. FIG. 2 illustrates the refrigerator 10 of FIG. 1 with the French doors 14, 16 open to illustrate drawers 24, 26 within the fresh food compartment of the refrigerator 10. One or more of the drawers 24, 26 may be a crisper drawer.

Figure 3:
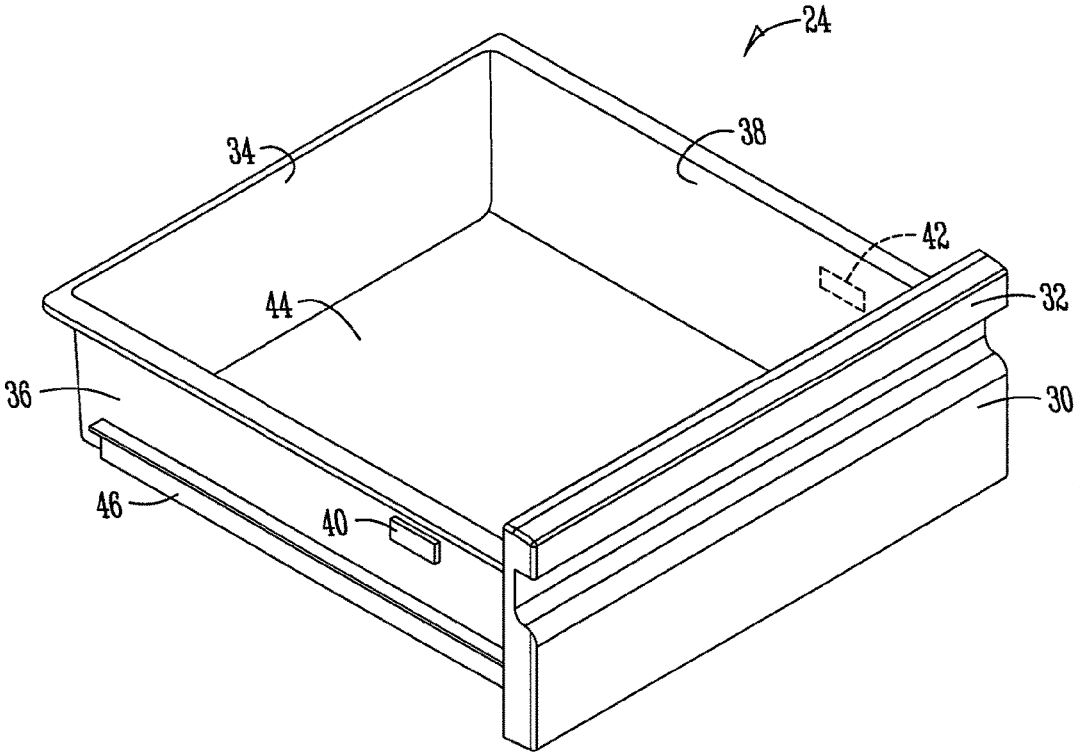
FIG. 3 illustrates one example of a drawer of the refrigerator of FIG. 1 and FIG. 2.

FIG. 3 illustrates drawer 24. The drawer 24 has a front 30, a back or rear 32 opposite the from 30, and opposite sides 36, 38. The front 30 may have a handle 32 to assist a user with opening or closing the drawer 24. The drawer also has a bottom 44. A guide member 46 is shown extending along the side 36 which may fit within a slot in the interior of the fresh food compartment of the refrigerator. Elements 40, 42 are also shown. Elements 40, 42 may be molded-in elements which are used to interact with a rotatable reflector and alter the position of the rotatable reflector in order to direct lighting differently when the drawer 24 is an open position or a closed position.

Figure 4:
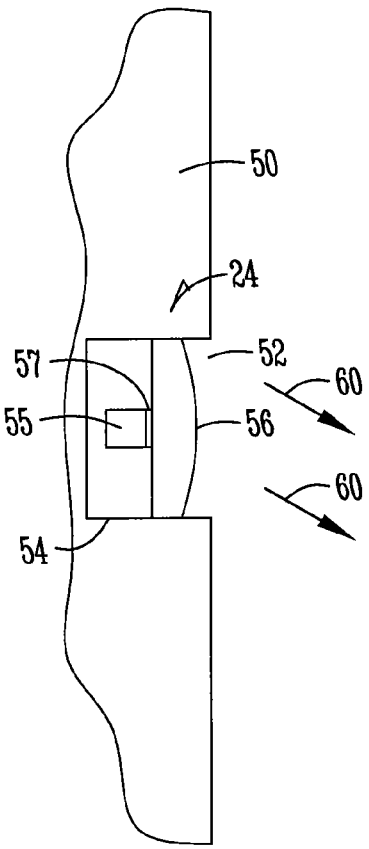
FIG. 4 illustrates an interior side within the refrigerator of FIG. 1 showing a light system which includes a light source and a rotatable reflector.

FIG. 4 illustrates an interior wall within the cabinet of the refrigerator. A vertical sidewall 50 is shown with a recess 52 therein. Integrated into the side wall is an optics assembly 58 which is positioned to be proximate a drawer. The optics assembly 58 includes a light source 54 and optionally a lens 57 which may be integrated with the light source 54. The light source 54 may include a light emitting diode (LED) 55, an array of LEDs or other types of lights. A reflector 56 is shown. The reflector may be a rotatable reflector. The reflector is shown in a first position in FIG. 4. The reflector is shown in a second position in FIG. 5. The reflector 56 may transition between the first position and the second position by rotating between the first position and the second position. In the first position, light from the light source 54 is directed in a first direction as shown by arrows 60 in FIG. 4. Reflecting the light in the first direction may be advantageous in various was such as to better light a drawer when the drawer is in an open position. Returning to FIG. 5, in the second position, light from the light source 54 is directed in a second direction as shown by arrows 62. Reflecting light in the second direction may be advantageous in various ways such as to better light a drawer when the drawer is in a closed position.

Figure 5:
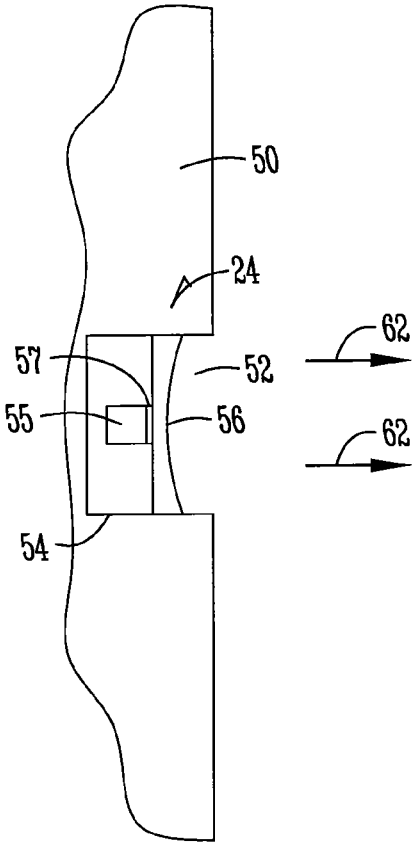
FIG. 5 illustrates an interior side within the refrigerator of FIG. 1 showing a light system which includes a light source and a rotatable reflector in a different position than that shown in FIG. 4.

The elements 40, 42 of FIG. 3 may travel through the recess 52 shown in FIG. 4 and FIG. 5 as the drawer opens and closes to thereby rotate the reflector and change its orientation to affect the direction of the light. The drawer may be present in the fresh food compartment, the freezer compartment, or elsewhere within a refrigerator.

Figure 6:
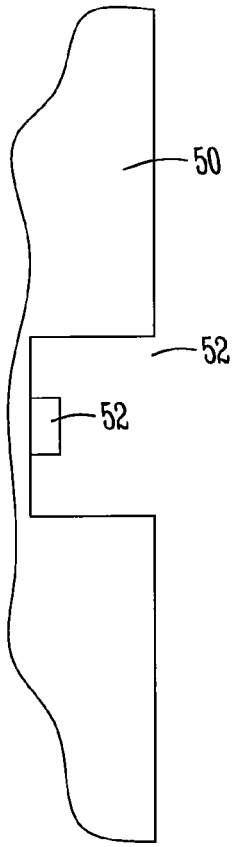
FIG. 6 illustrates an interior side within the refrigerator of FIG. 1 showing a sensor for detecting drawer movement or position.
Figure 7:
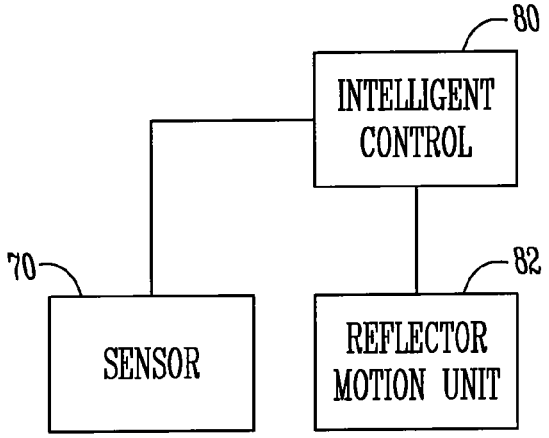
FIG. 7 is a block diagram showing using the sensor of FIG. 6 to control movement of a reflector.

FIG. 6 and FIG. 7 illustrate another example where a reflector is moved between a plurality of different positions in response to a user's interactions with the refrigerator. In FIG. 6, an interior sidewall 50 of the refrigerator is shown with a recess 52. The recess 52 may receive a structural element 40 of the drawer 24 of FIG. 3. Returning to FIG. 6, within the recess 72 may be a sensor 70. The sensor 70 may be a contact sensor or switch used to determine a position of the drawer such as open or closed. As shown in FIG. 7, the sensor 70 may be operatively connected to an intelligent control 80 which may be a controller, microcontroller, processor, or other type of intelligent control. The intelligent control 80 may be further operatively connected to a reflector motion unit 82. The reflector motion unit 82 may include a motor, servo, actuator, or other type of device for imparting movement to a reflector operatively connected to the reflector motion unit 82. Thus, the reflector may be moved in response to opening and closing of a drawer within the refrigerator. In the example shown in FIG. 6 and FIG. 7, the light source and reflector may be positioned remotely from the drawer.

It is to be further understood that it is contemplated that the direction of lighting within a refrigerator may otherwise be altered in response to an individual's interactions with the refrigerator. Thus, when a drawer is opened or another area is accessed or component is moved within the refrigerator, lighting may be altered directionally or otherwise to increase lighting to the area of interest to the user.

Therefore, a refrigerator with interactive lighting has been described. Numerous options, variations, and alternatives are contemplated including variation in the type of light source, variation in the type of reflector, the manner in which an individual interacts with the refrigerator, the manner in which light direction is altered, or other options, variations, and alternatives.

What is claimed is:

1. A refrigerator comprising:
a refrigerator cabinet;
a light system associated within an interior of the refrigerator cabinet, the light system comprising:
(a) a light source, said light source being positioned proximate a drawer in the refrigerator;
(b) a rotatable reflector having a first position wherein light from the light source is directed in a first direction and a second position wherein the light from the light source is directed in a second direction;
(c) wherein the refrigerator comprises elements on the sides of the drawer configured to control rotation of the rotatable reflector between the first and second position.

2. The refrigerator of claim 1 wherein the reflector is in the first position when the drawer is closed.

3. The refrigerator of claim 1 wherein the reflector is in the second position when the drawer is open.

4. The refrigerator of claim 2 wherein the light source is positioned on an interior side of the refrigerator cabinet.

5. The refrigerator of claim 1 wherein the elements are molded-in elements.

6. The refrigerator of claim 1 wherein the drawer is a crisper.

7. The refrigerator of claim 1 wherein the light source comprises an LED.

8. The refrigerator of claim 1 wherein the elements control rotation of the rotatable reflector between the first position and the second position with movement of the drawer between the open position and the closed position.

9. A refrigerator comprising:
a refrigerator cabinet, said refrigerator cabinet having an interior wall;
a light system associated within an interior of the refrigerator cabinet, the light system comprising:
(a) a light source, said light source being positioned proximate a drawer in the refrigerator;
(b) a rotatable reflector having a first position wherein light from the light source is directed in a first direction and a second position wherein the light from the light source is directed in a second direction;
(c) wherein the refrigerator comprises elements on the sides of the drawer configured to control rotation of the rotatable reflector between the first and second position;
(d) and further providing a recess in the interior wall configured to receive the elements as the drawer opens and closes to thereby rotate the rotatable reflector and change its orientation to affect the direction of light emanating from the light source.

10. The refrigerator of claim 9 wherein the elements are molded on the sides of the drawer.

11. The refrigerator of claim 9 further including a sensor within the recess.

12. The refrigerator of claim 11 whereby the sensor is a contact sensor or switch configured to determine a position of the drawer as open or closed.

13. The refrigerator of claim 12 whereby the sensor is operatively connected to an intelligent control.

14. The refrigerator of claim 13 whereby the intelligent control is operatively connected to a reflector motion unit.

15. The refrigerator of claim 14 whereby the reflector motion unit includes a device selected from the group consisting of a motor, a servo, and an actuator.

16. A method of controlling interactive lighting in a refrigerator, the method comprising:

providing a refrigerator having a refrigerator cabinet, and a light system associated within an interior of the refrigerator cabinet, said interior cabinet having an interior wall, the light system comprising: (a) a light source, said light source being positioned proximate a drawer in the refrigerator (b) a rotatable reflector having a first position wherein light from the light source is directed in a first direction and a second position wherein the light from the light source is directed in a second direction, and (c) elements on the sides of the drawer;

controlling direction of the light based on the interactions between the elements and the rotatable reflector, whereby the direction of the light is controlled by receiving the elements in a recess of the interior wall to thereby rotate the rotatable reflector.

17. The method of claim 16 further including the step of engaging a sensor in the recess of the interior wall to determine a position of the drawer.

18. The method of claim 17 whereby the position of the drawer is open or closed.

* * * * *